United States Patent [19]

Grimes

[11] Patent Number: 5,048,783

[45] Date of Patent: Sep. 17, 1991

[54] IRONING BOARD TRAY BRACKET

[76] Inventor: Leon Grimes, 2929 Claymille Blvd., Nashville, Tenn. 37207

[21] Appl. No.: 624,724

[22] Filed: Dec. 10, 1990

[51] Int. Cl.[5] ..... A47B 96/06

[52] U.S. Cl. ..... 248/231.2; 248/117.1

[58] Field of Search ..... 248/231.2, 117.1; 38/106, 107, 111; 104/93

[56] References Cited

U.S. PATENT DOCUMENTS

| | | | |
|---|---|---|---|
| 1,018,530 | 2/1912 | Tiedemann | 248/117.1 |
| 1,302,866 | 5/1919 | Smith | 248/117.1 X |
| 1,855,751 | 4/1932 | Buchanan | 248/231.2 |
| 1,994,777 | 3/1935 | MacKenzie | 248/117.1 |
| 2,723,097 | 11/1955 | Tyler | 38/107 UX |
| 2,949,272 | 8/1960 | Walls | 248/231.2 |
| 3,268,192 | 8/1966 | Munson | 38/107 X |
| 3,367,611 | 2/1968 | Munson | 248/117.1 |
| 3,435,957 | 4/1967 | Lloyd | 38/106 X |
| 3,438,604 | 4/1969 | Tashjian | 248/117.1 |
| 3,522,887 | 8/1970 | Petersen | 248/231.2 X |
| 3,913,878 | 10/1975 | Wayne | 248/311 |
| 3,926,392 | 12/1975 | Davidson | 248/117.1 |
| 4,779,365 | 10/1988 | Theeten | 38/135 |
| 4,878,645 | 11/1989 | O'Neill | 248/231.2 X |

FOREIGN PATENT DOCUMENTS

| | | | |
|---|---|---|---|
| 2072711 | 10/1981 | United Kingdom | 38/107 |

*Primary Examiner*—J. Franklin Foss

*Attorney, Agent, or Firm*—Mark J. Patterson; Edward D. Lanquist, Jr.

[57] ABSTRACT

An ironing board tray bracket for use in all modern ironing boards having a track that directs the extension and retraction of the ironing board legs. The bracket fits within the track and is adjustable to conform the width of the track. An arm attaches to the bracket on one end and a tray on the other end. The tray can be used for temporary storage of the iron or other ironing accessories. An iron clip is provided on the tray to hold the iron in place.

5 Claims, 3 Drawing Sheets

IRONING BOARD TRAY BRACKET

APPLICATION FOR UNITED STATES LETTERS PATENT

Be it known that I, Leon Grimes, a citizen of the United States, residing at 2929 Claymille Boulevard, Nashville, Tenn., have invented a new and useful "Ironing Board Tray Bracket".

BACKGROUND OF THE INVENTION

The present invention relates generally to an ironing board tray bracket and more specifically to an ironing board tray bracket that uses the track integral to most ironing boards used by the ironing board to direct the legs for extension and retraction.

It will be appreciated by those skilled in the art that housewives and others who use irons are often forced to place the iron, and other ironing accessories such as spray bottles, on the iron board. Given the size of most ironing boards, there is barely enough room for a garment to be ironed. To this end, there have been several attempts to provide an ironing tray that attaches to the ironing board for placement of the iron and other ironing accessories.

One such attempt was disclosed in U.S. Pat. No. 4,779,365 issued to B. Theeten on Oct. 25, 1988. Theeten discloses an ironing board surface that has a base, rectangularly-shaped table and two ironing surfaces placed on a horizontal plane above the base table. Below one of these ironing surfaces, a basket is placed which rolls in and out from beneath one of the ironing surfaces. However, this device cannot be used with a standard household ironing board.

Another such attempt was disclosed is U.S. Pat. No. 4,910,892 issued to F. Ruschitzka. Ruschitzka discloses an ironing board that has various flip-out trays. Unfortunately, the flip-out trays disclosed by Ruschitzka cannot be placed on a standard ironing board. More importantly, Ruschitzka fails to take advantage of the integral components of a usual ironing board.

U.S. Pat. No. 3,913,878 issued to F. Wayne on Oct. 21, 1975, discloses an ironing board attachment. Wayne uses a basket that is attached to the ironing board by using a bracket that releasable attaches to the ironing board by use of screws. Unfortunately, through its method of attachment, at least a portion of the Wayne device must always be on the ironing surface, thereby preventing a portion of the ironing surface from being used.

U.S. Pat. No. 3,926,392 issued to W. Davidson discloses an ironing board tray that attaches to the ironing board surface by use of a bracket that releasably attaches to the lip or rim of the ironing board surface. Like all others, this patent fails to take advantage of the track that is integral to all domestic ironing boards. Although it does not attach to the top of the ironing surface, Davidson would still interfere with ironing, as it attaches to an exposed side of the ironing board, thereby possibly slicing or fraying the garment to be ironed. Also, Davidson may cause problems where the lip of the ironing board has an additional web underneath it, thereby making it impossible to attach a bracket to the side.

U.S. Pat. No. 3,438,604 issued to E. Tashjian on Apr. 15, 1969 discloses an ironing press with a retractable tray that uses a track. However, this is a separate track from that which is integral to most domestic ironing boards.

What is needed, then, is an ironing board tray bracket that uses the track integral to all domestic ironing boards. This needed device must keep the attachment bracket away from the ironing surface so that the garment or other material to be ironed is not cut or frayed. This needed device must be usable with all types of modern, domestic ironing boards. This bracket must be easily removed or easily stored. This device is presently lacking in the prior art.

SUMMARY OF THE INvENTION

In the present device, a bracket is formed using a base plate having a first and second side. A first side plate is slidably attached to the first side of the base plate, and a second side plate is attached to the second side of the base plate. The first side plate and the second side plate are substantially coplanar. Modern ironing boards have an integral track for direction of the ironing board legs during extension and retraction of the legs. Side plates are moved together until they almost touch and are placed in the track integral to the ironing board. Side plates are then extended until the webs of the side plates contact the sides of the track. In the manual embodiment, screws are used to hold side plates in an extended position. In the automatic embodiment, a spring or other bias means is used to extend side plates apart until they contact with sides of track.

An arm is used that attaches to the bracket at one end. The other end of arm attaches to a tray that can hold the iron or other ironing accessories. An iron clip is provided on the tray to receive iron. Arm is pivotally attached to bracket for storage.

Accordingly, an object of the present invention is to provide a bracket that uses a bracket integral to the domestic ironing board.

Another object of the present invention is to provide a bracket away from the ironing surface to prevent the fabric to be ironed from being cut or frayed.

Still another object of the present invention is to provide a bracket that can be used for all modern ironing boards.

Still another object of the present invention is to provide an ironing board tray that can be easily removed or stored with the modern ironing board.

DESCRIPTION OF THE PREFERRED EMBODIMENT

Figure 1:
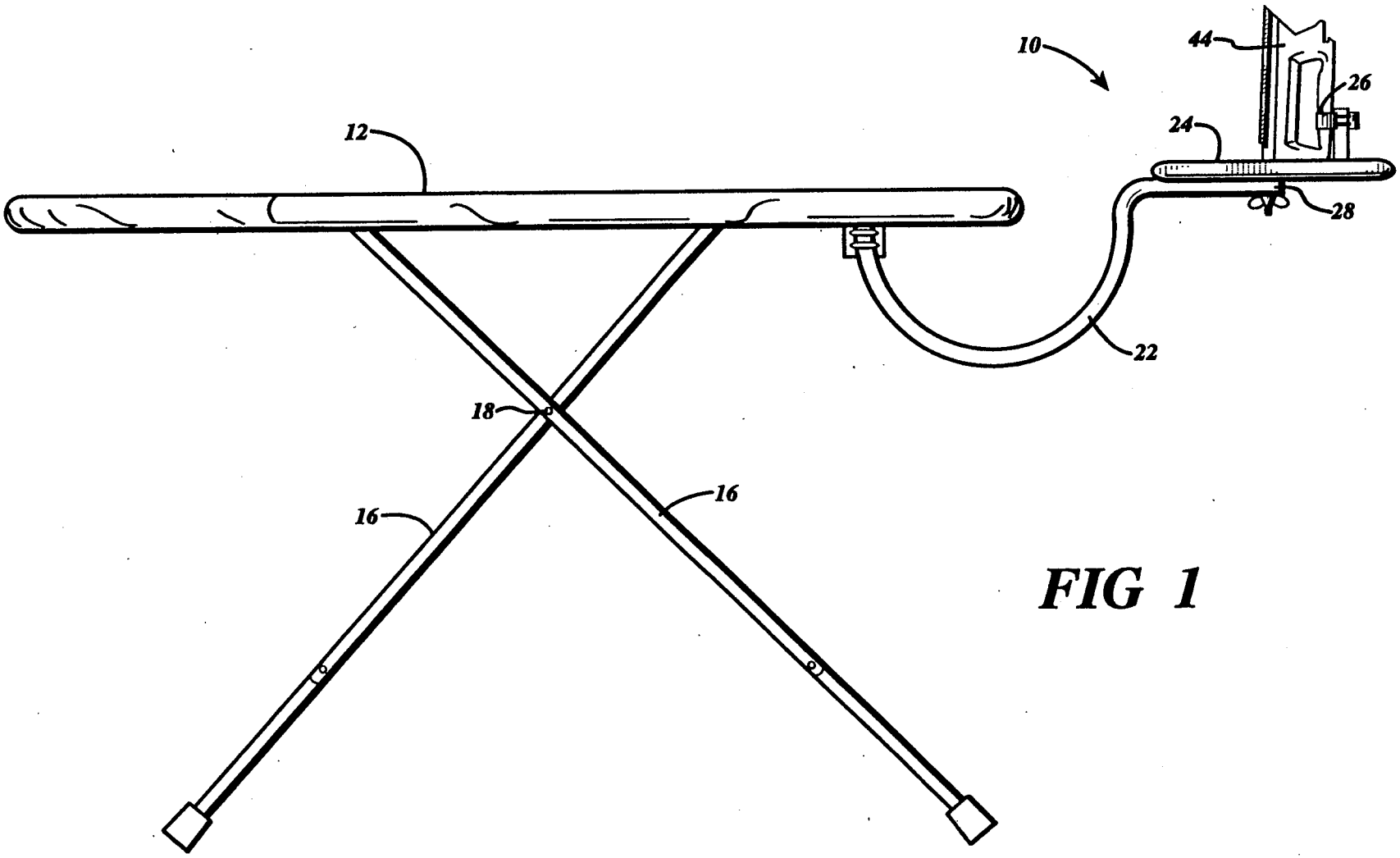
FIG. 1 is a side view of the device attached to an ironing board.

Referring noW to FIG. 1, there is shown generally at 10 the ironing board tray bracket of the present invention. Iron board tray bracket 10 has arm 22 attached to bracket. Arm 22 in turn attaches to tray 24 by attachment 28. Tray 24 has clip 26 extending substantially vertically for releasable attachment to iron 44. Modern ironing board 12 has legs 16 pivoting against One another at pin 18. Upper portion Of legs 16 attaches to and is directed by track (14 in FIG. 3).

Figure 2:
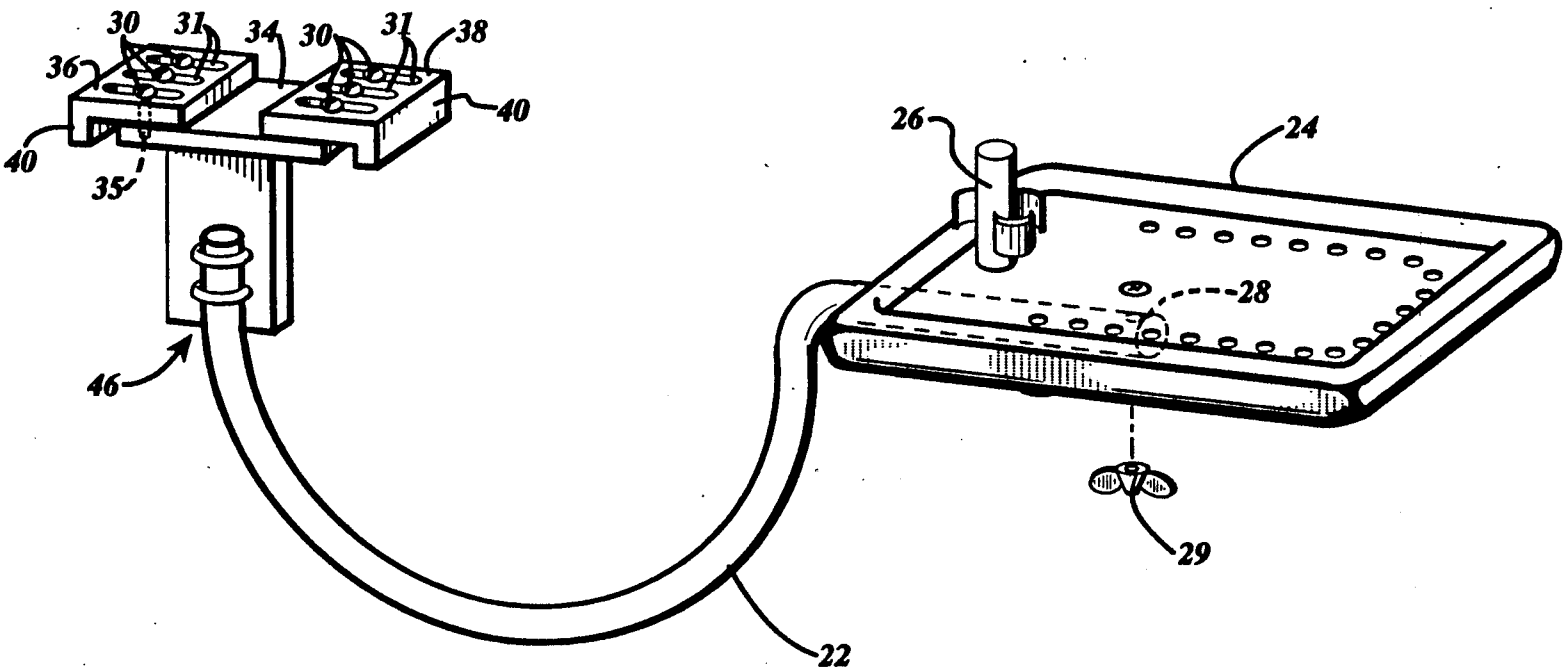
FIG. 2 is a perspective view of the device as it is attached to the arm and to the tray.

FIG. 2 shows a perspective view of ironing board tray bracket 10. Expandable bracket 20 is made of base plate 34 that has holes 35 placed through it to receive screws 30. In turn, screws 30 are releasably attached to side plates 36, 38 by slots 31. First side plate 36 and second side plate 38 are substantially coplanar. Because of slots 31, side plates 36, 38 can be mOVed almost together or apart. Side plates 36, 38 have webs 40 that engage and/or contact track (14 of FIG. 3). Base plate 34 attaches to arm 22 which in turn attaches to tray 24 by attachment 28. In the preferred embodiment, attachment 28 is achieved by wing nut 29. Clip 26 releasably holds iron (44 in FIG. 1) in place on tray 24.

Figure 3:
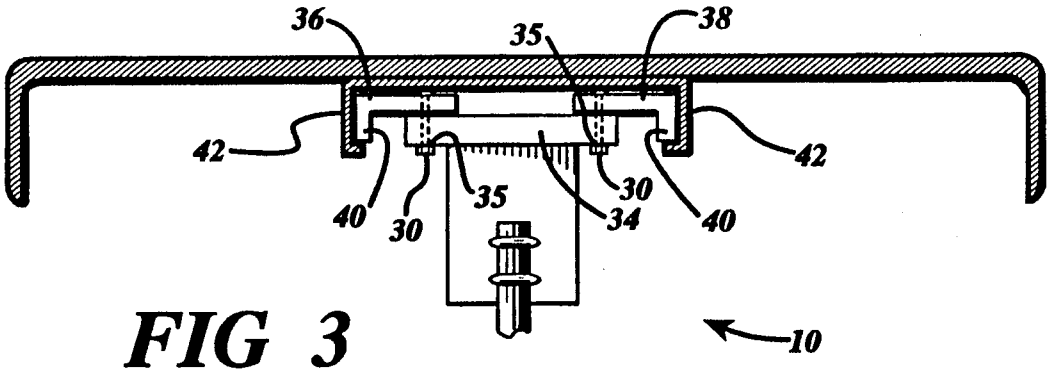
FIG. 3 is a cutaway view showing the manual embodiment of the bracket as it fits within the ironing board track.

Referring now to FIG. 3, there is shown generally at 10 the ironing board tray bracket of the present invention as it fits into tray 14 of ironing board (12 in FIG. 1). As Stated earlier, modern ironing boards have track 14 integral to them to receive and direct the upper portions of the legs during retraction and extension. The present device 10 is intended to fit within track 14. However, the sizes of track 14 can vary among different makes. Therefore, certain extension is required. The present invention provides this extension by having base plate 34 with slots 31 placed through it. Screws 30 follow slots 31 back and forth during movement of side plates 36, 38 outwardly and inwardly. As webs 40 contact sides 42 of track 14, user may tighten screws 30 to hold side pieces 36, 38 in place.

Figure 4:
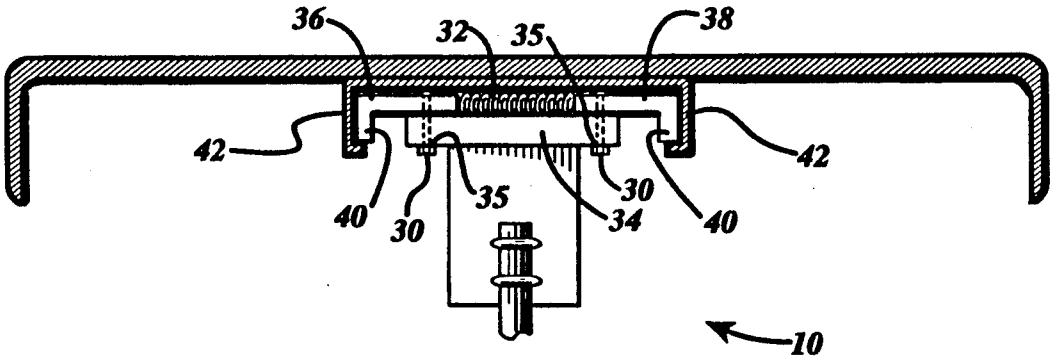
FIG. 4 is a front view of the automatic embodiment of the bracket.

In FIG. 4, an automatic version of bracket 10 is shown. In this instance, side pieces 36, 38 slidably attach to base plate 34 in the same way. However, spring 32 or another biasing mechanism is used to force side plates 36, 38 apart. Therefore, user can place device 10 in track 14 by releasing side plates 36, 38, bracket 10 automatically assumes the width of track 14 such that webs 44 contact sides 42.

In the preferred embodiment, side plates 36, 38 are substantially 2 inches wide from web 40 to other side. Base plate 34 is substantially 4 inches wide. Therefore, in the preferred embodiment, side plates 36, 38 will never contact one another but will come twice the thickness of web 40 from contacting one another.

After user is finished with ironing board 12, bracket 10 can be removed from track 14. Otherwise, bracket 10 can remain in track 14, and tray 24 that previously extended to beyond board 12 can be pivoted using pivot 46 so that it takes up less room.

Thus, although there have been described particular embodiments of the present invention of a new and useful ironing board tray bracket, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A device for releasably attaching a tray to an ironing board having an integral track comprising:

a. a bracket received by said track;

b. means for adjusting the width of said bracket for flush fit within said track;

c. an arm pivotally attached to said bracket extendable away from said ironing board during use and storable under said ironing board during storage; and d. said tray pivotally attached to said arm.

2. The device of claim 1 wherein the means for widening the bracket comprise:

a. a base plate having a first end and a second end, said base plate having holes placed through it;

b. a first side plate and a second side plate in substantial coplanar alignment;

c. means to slidably attach said first side plate to said first side and said second side plate to said second side.

3. The device of claim 2 wherein said means to slidably attach said first side plate to said first side and said second side plate to said second side comprises:

a. said base plate having a hole placed through it on said first side and said second side;

b. a screw placed through said hole in said first side and said second side;

c. said first side plate and said second side plate each having a slot placed through it for receiving said screw, said slots aligned substantially perpendicular to said track.

4. A bracket for attaching a tray to an ironing board having an integral track comprising:

a. a base plate having a first side and a second side, said base plate having a hole placed through said first side, said base plate having a hole placed through said second side;

b. a screw for placement in each of said holes in said base plate;

c. a first side plate having slots placed through it for receive of said screw;

d. a second side plate having a slot for receipt of said screw;

e. said slots aligned substantially perpendicular to said track;

f. an arm pivotally attached to said bracket extendable away from said ironing board during use and storable under said ironing board during storage; and g. said tray pivotally attached to said arm.

5. The bracket of claim 4 further comprising a means of biasing said first plate away from said second plate.

* * * * *